US005848569A

United States Patent [19]

Maki et al.

[11] Patent Number: 5,848,569

[45] Date of Patent: Dec. 15, 1998

[54] CRUSHING DEVICE

[75] Inventors: Kyle R. Maki, Eveleth; Ted M. Sellars, Chisholm, both of Minn.

[73] Assignee: Kyle Maki, Eveleth, Minn.

[21] Appl. No.: 959,006

[22] Filed: Oct. 28, 1997

[51] Int. Cl.[6] ..... B30B 9/32

[52] U.S. Cl. ..... 100/258 A; 100/293; 100/902; D15/123

[58] Field of Search ..... 100/233, 258 A, 100/293, 902; D15/123

[56] References Cited

U.S. PATENT DOCUMENTS

| | | | |
|---|---|---|---|
| D. 324,390 | 3/1992 | Byers | 100/902 |
| 3,687,062 | 8/1972 | Frank . | |
| 4,088,072 | 5/1978 | Wittmeier . | |
| 4,261,259 | 4/1981 | Beardslee . | |
| 4,498,385 | 2/1985 | Manley | 100/902 |
| 4,526,096 | 7/1985 | LaBarge et al. . | |
| 4,890,552 | 1/1990 | Yelczyn | 100/902 |
| 5,507,222 | 4/1996 | Reavey . | |
| 5,584,239 | 12/1996 | Yelczyn et al. | 100/902 |

*Primary Examiner*—Stephen F. Gerrity

*Attorney, Agent, or Firm*—David Volk

[57] ABSTRACT

A first frame has a first end and a second end, two opposing first frame side walls and a first pivot pin extending laterally between the first frame side walls at the second end of the first frame. A generally planar first barrier is attached to the first pivot pin such that the first barrier is pivotal about the first pivot pin. A second frame has a primary end and a secondary end, the second frame comprising two opposing second frame side walls, each of the second frame side walls being pivotally attached at the secondary end of the second frame to one of the first frame side walls at the first end of the first frame. A second pivot pin extends laterally between the second frame side walls between the primary end and the secondary end. A generally planar second barrier is attached to the second pivot pin such that the second barrier is pivotal about the second pivot pin. The first barrier and the second barrier are positioned in an opposed manner to each other. A pair of rods are positioned laterally between the first barrier and the second barrier, and are configured to guide the second barrier toward the first barrier when the second frame is pivoted toward the first barrier. A crushable article placed between the first and second barriers is crushed between the first and the second barrier when the second frame is pivoted toward the first barrier.

5 Claims, 5 Drawing Sheets

CRUSHING DEVICE

BACKGROUND OF THE INVENTION

1. Field of the Invention

The present invention relates to devices for crushing articles.

2. Description of the Related Art

Storing recyclables for pick-up has become a mandatory chore for persons across the United States. Aluminum cans, for example, are a commonly recycled item. Crushing the cans and other containers saves space and makes room for other recyclables. What is needed is an inexpensive apparatus which makes crushing of containers easy and convenient. Such an apparatus may be applied to crushing of other types of articles as well.

SUMMARY OF THE INVENTION

The crushing device of the present invention includes a first frame having a first end and a second end, two opposing first frame side walls and a first pivot pin extending laterally between the first frame side walls at the second end of the first frame. A generally planar first barrier is attached to the first pivot pin such that the first barrier is pivotal about the first pivot pin.

A second frame has a primary end and a secondary end, the second frame comprising two opposing second frame side walls. Each of the second frame side walls is pivotally attached at the secondary end of the second frame to one of the first frame side walls at the first end of the first frame.

A second pivot pin extends laterally between the second frame side walls between the primary end and the secondary end. A generally planar second barrier is attached to the second pivot pin such that the second barrier is pivotal about the second pivot pin.

The first barrier and the second barrier are positioned in an opposed manner to each other. A pair of rods are positioned laterally between the first barrier and the second barrier, and are configured to guide the second barrier toward the first barrier when the second frame is pivoted toward the first barrier.

A crushable article placed between the first and second barriers is crushed between the first and the second barrier when the second frame is pivoted toward the first barrier.

Still further features and advantages will become apparent from the ensuing description and drawings.

DETAILED DESCRIPTION

Figure 1:
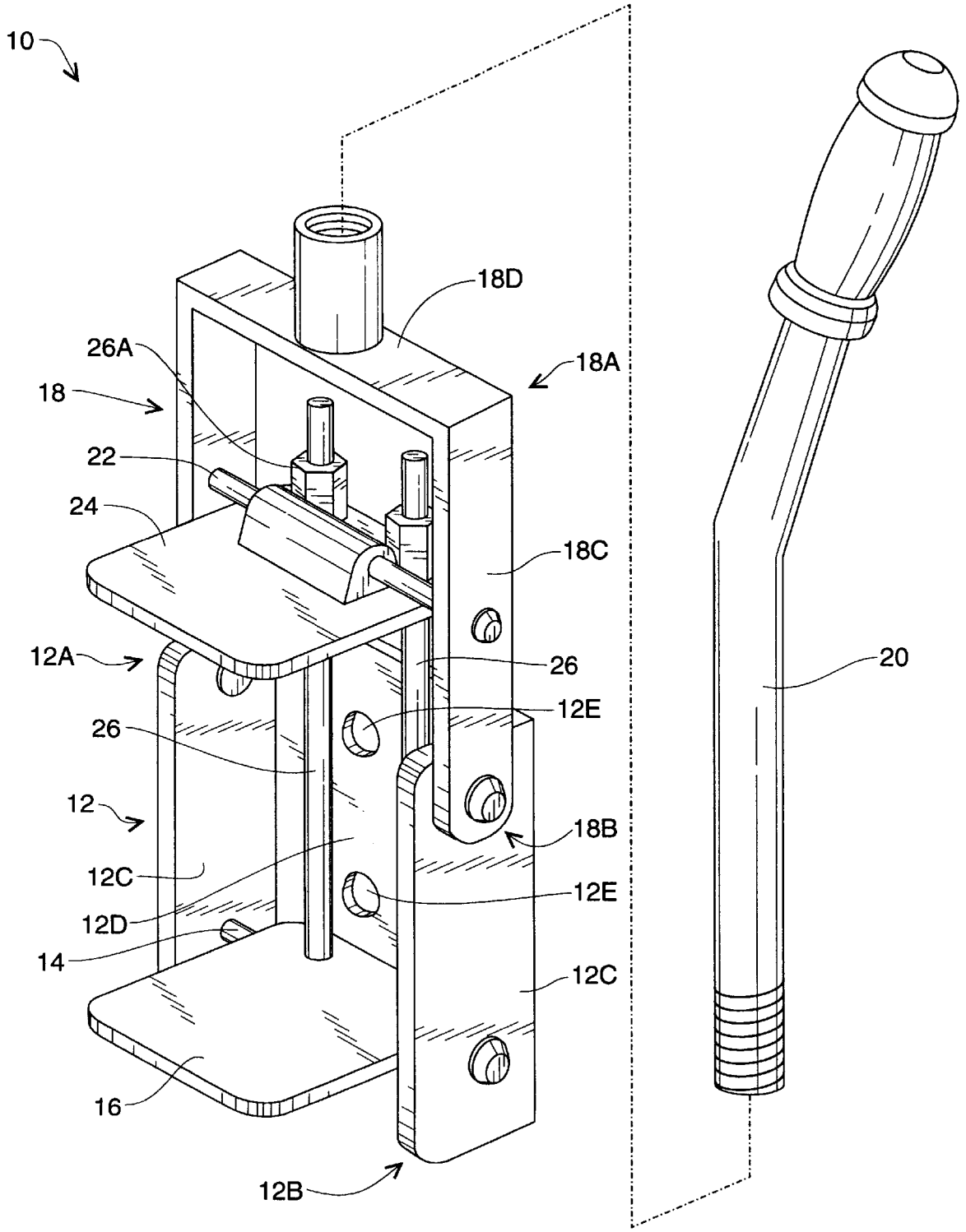
FIG. 1 is a perspective view of a crushing device of the present invention.
Figure 2:
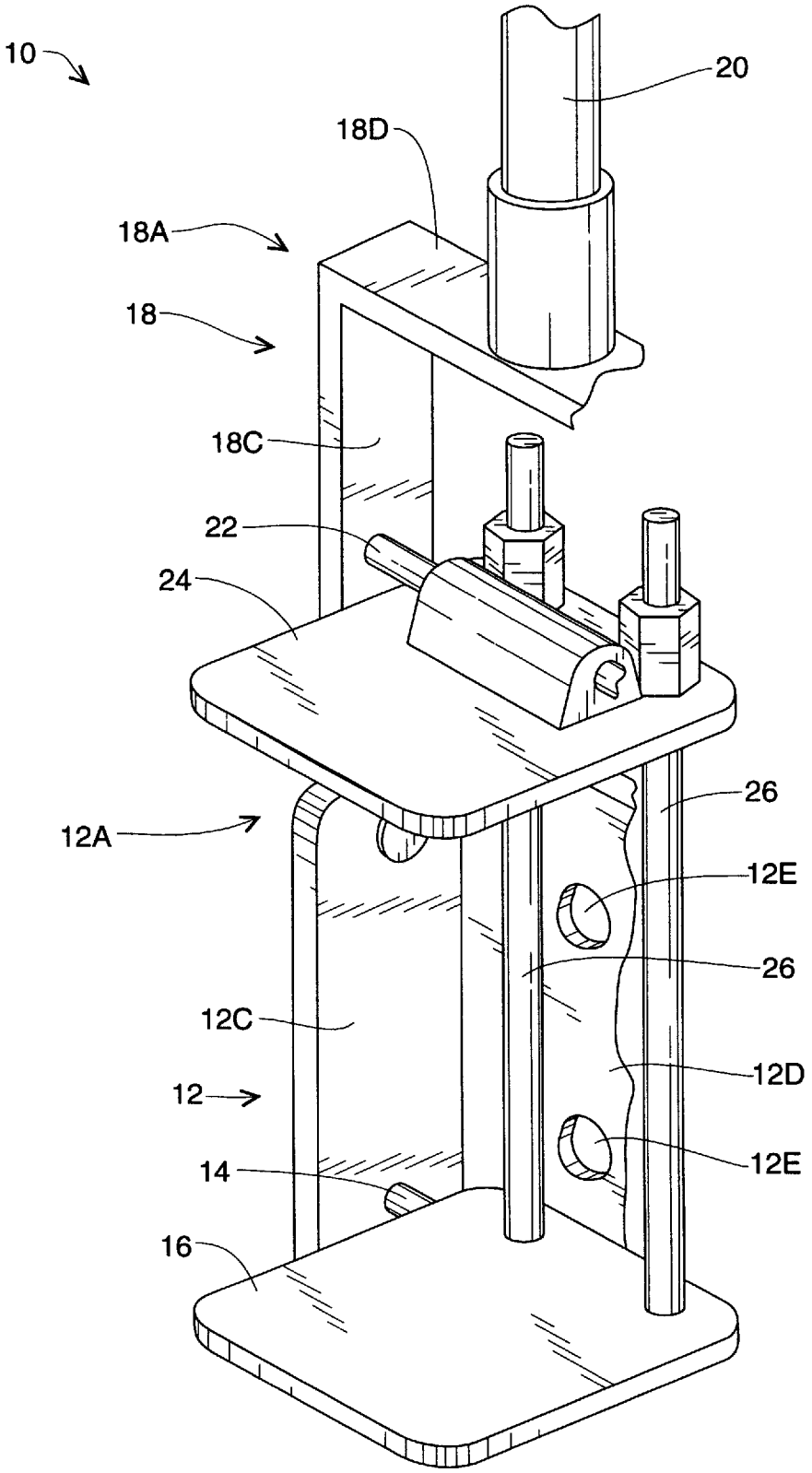
FIG. 2 is a perspective view of the crushing device, with a portion broken away to show additional details.
Figure 3:
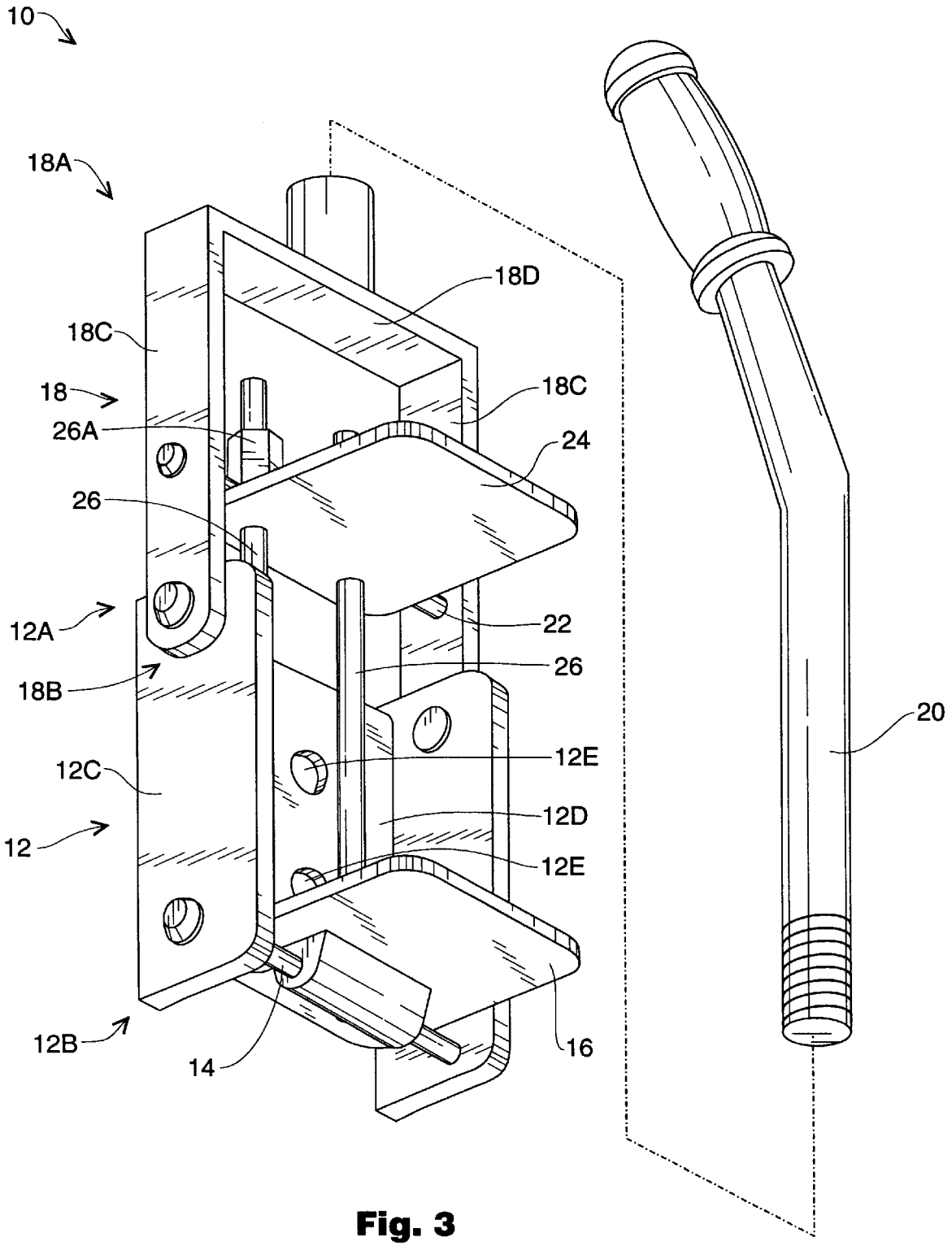
FIG. 3 is a bottom perspective view of the crushing device.

FIG. 1 is a perspective view of a crushing device 10 of the present invention. FIG. 2 is a perspective view of the crushing device 10, with a portion broken away to show additional details. FIG. 3 is a bottom perspective view of the crushing device 10. Referring to FIGS. 1–3, the crushing device 10 includes a first frame 12 having a first end 12A and a second end 12B.

The first frame 12 has two opposing first frame side walls 12C and a back wall 12D. The back wall 12D includes structure forming apertures 12E for screwing or bolting the back wall 12D flush to a vertical surface such as a building wall 30 (see FIGS. 4 and 5). Although apertures 12E are shown, any conventional means of mounting the first frame 12 in an upright position is within the scope of the present invention.

A first pivot pin 14 extends laterally between the first frame side walls 12C at the second end 12B of the first frame 12. A generally planar first barrier 16 is attached to the first pivot pin 14 such that the first barrier 16 is pivotal about the first pivot pin 14.

A second frame 18 has a primary end 18A and a secondary end 18B. The second frame 18 comprises two opposing second frame side walls 18C. An end wall 18D extends laterally between the second frame side walls 18C at the primary end 18A. An elongated handle 20 is threadedly attachable to the end wall 18D.

Each of the second frame side walls 18C is pivotally attached at the secondary end 18B of the second frame 18 to one of the first frame side walls 12C at the first end 12A of the first frame 12.

A second pivot pin 22 extends laterally between the second frame side walls 18C between the primary end 18A and the secondary end 18B. A generally planar second barrier 24 is attached to the second pivot pin 22 such that the second barrier 24 is pivotal about the second pivot pin 22.

The first barrier 16 and the second barrier 24 are positioned in an opposed manner to each other. A pair of rods 26 are positioned laterally between the first barrier 16 and the second barrier 24. The rods 26 are fixedly connected at one end thereof to the first barrier 16, and extend through the second barrier 24. The second barrier 24 is slidable along the rods 26. Stop members 26A, which may be threaded nuts as shown, are positioned on the rods 26 near distal ends thereof to restrain the second barrier 24 from movement beyond the stop members 26A and off of the rods 26.

Figure 4:
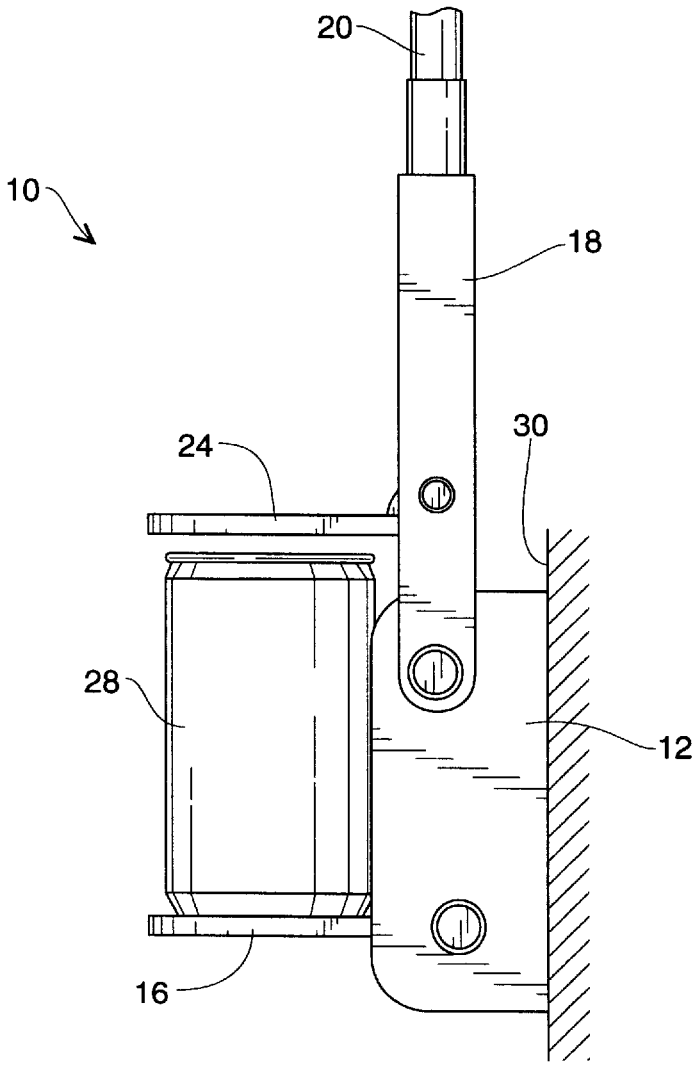
FIGS. 4 and 5 are elevational views showing the crushing device in use.
Figure 5:
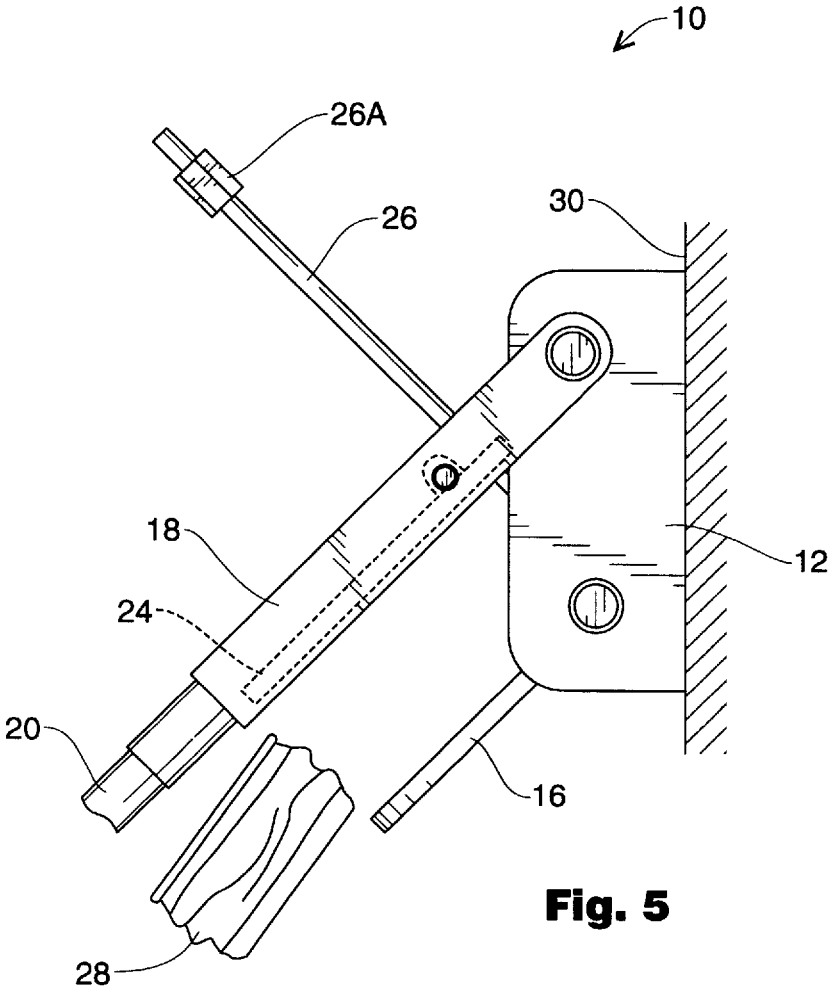

FIGS. 4 and 5 are elevational views showing the crushing device 10 in use. The back wall 12D is mounted to a wall 30. Referring to FIG. 4, a crushable article such as an aluminum can 28 is placed between the first and second barriers 16, 24. Referring to FIG. 5, the can 28 is crushed between the first and the second barriers 16, 24 when the second frame 18 is pivoted downward toward the first barrier 16. The rods 26 are configured to guide the second barrier 24 toward the first barrier 16, such that the lateral position of the second barrier 24 relative to the first barrier 16 remains constant.

Because the rods 26 are fixedly attached to the first barrier 16 and slidably attached to the second barrier 24, which is pivotally attached to the second frame 18, the first barrier 16 and the second barrier 24 both pivot about their respective pivot pins 14, 22 when the first frame 18 is pivoted. Because the first barrier 16 and the second barrrier 24 each tilt downward as the first frame 18 is pivoted downward, the crushed can 28 falls off of the first barrier 16 as soon as the first frame 18 begins to tilt back upward so that the can 28 is no longer captured between the first and second barriers 16, 24. A bin (not shown) for catching the crushed cans 28 can be placed below the crushing device 10.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention.

Accordingly, the scope of the invention is to be limited only by the following claims and their legal equivalents.

The invention claimed is:

1. A crushing device comprising:

a. a first frame having a first barrier pivotally attached thereto;

b. a second frame having a second barrier pivotally attached thereto;

c. the second frame pivotally attached to the first frame;

d. the first barrier and the second barrier positioned in an opposed manner to each other;

e. at least one rod spanning from the first barrier, to and through the second barrier for guiding the second barrier toward the first barrier when the second frame is pivoted toward the first barrier, while maintaining a constant lateral position of the second barrier relative to the first barrier; and f. a stop member positioned on the rod in such a manner as to restrict movement of the second barrier away from the first barrier beyond the stop member;

g. whereby a crushable article placed between the first and second barriers is crushed between the first and the second barrier when the second frame is pivoted toward the first barrier.

2. The crushing device of claim 1, wherein the stop member is annularly disposed about the rod.

3. A crushing device comprising:

a. a first frame having a first end and a second end, two opposing first frame side walls and a first pivot pin extending laterally between the first frame side walls at the second end of the first frame;

b. a generally planar first barrier attached to the first pivot pin such that the first barrier is pivotal about the first pivot pin;

c. a second frame having a primary end and a secondary end, the second frame comprising two opposing second frame side walls, each of the second frame side walls being pivotally attached at the secondary end of the second frame to one of the first frame side walls at the first end of the first frame;

d. the second frame having a handle means at the primary end of the second frame;

e. the second frame having a second pivot pin extending laterally between the second frame side walls between the primary end and the secondary end;

f. a generally planar second barrier attached to the second pivot pin such that the second barrier is pivotal about the second pivot pin;

g. the first barrier and the second barrier positioned in an opposed manner to each other;

h. at least one rod spanning from the first barrier, to and through the second barrier, and configured to guide the second barrier toward the first barrier when the second frame is pivoted toward the first barrier; and i. a stop member positioned on the rod in such a manner as to restrict movement of the second barrier away from the first barrier beyond the stop member;

j. whereby a crushable article placed between the first and second barriers is crushed between the first and the second barrier when the second frame is pivoted toward the first barrier.

4. The crushing device of claim 3, wherein the stop member is annularly disposed about the rod.

5. The crushing device of claim 3, wherein the stop member is a nut.

* * * * *